US010937581B2

(12) United States Patent
Kim et al.

(10) Patent No.: US 10,937,581 B2
(45) Date of Patent: Mar. 2, 2021

(54) HYBRID INDUCTOR AND MANUFACTURING METHOD THEREOF

(71) Applicant: SAMSUNG ELECTRO-MECHANICS CO., LTD., Suwon-si (KR)

(72) Inventors: Ho Yoon Kim, Suwon-si (KR); Yu Jin Choi, Suwon-si (KR); Soo Hwan Son, Suwon-si (KR); Min Kyoung Cheon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/266,617

(22) Filed: Feb. 4, 2019

(65) Prior Publication Data

US 2019/0172618 A1 Jun. 6, 2019

Related U.S. Application Data

(63) Continuation of application No. 15/009,125, filed on Jan. 28, 2016.

(30) Foreign Application Priority Data

Apr. 1, 2015 (KR) ..... 10-2015-0046310

(51) Int. Cl.
*H01F 17/00* (2006.01)
*H01F 3/10* (2006.01)
(Continued)

(52) U.S. Cl.
CPC ..... *H01F 3/10* (2013.01); *H01F 17/0013* (2013.01); *H01F 17/04* (2013.01); *H01F 41/046* (2013.01); *H01F 2003/106* (2013.01)

(58) Field of Classification Search
CPC ..... H01F 17/0013
See application file for complete search history.

(56) References Cited

U.S. PATENT DOCUMENTS 6,459,351 B1 * 10/2002 Maki ..... H01F 27/2804 336/200
6,515,568 B1 * 2/2003 Maki ..... H01F 3/10 336/200

(Continued)

FOREIGN PATENT DOCUMENTS

JP 09270334 A * 10/1997 ..... H01F 27/2871
JP H09-270334 A 10/1997

(Continued)

OTHER PUBLICATIONS

Non-final U.S. Office Action dated Nov. 2, 2018 issued in U.S. Appl. No. 15/009,125.

(Continued)

*Primary Examiner* — Elvin G Enad
*Assistant Examiner* — Malcolm Barnes
(74) *Attorney, Agent, or Firm* — Morgan, Lewis & Bockius LLP

(57) ABSTRACT

A hybrid inductor includes an inductor body having a core part in which a coil part is disposed, and first and second cover parts having the core part interposed therebetween. The core part includes magnetic metal layers, and the first and second cover parts include ferrite layers.

20 Claims, 6 Drawing Sheets

(51) Int. Cl.
*H01F 17/04* (2006.01)
*H01F 41/04* (2006.01)

(56) References Cited

U.S. PATENT DOCUMENTS

| | | | | |
|---|---|---|---|---|
| 7,034,637 | B2 * | 4/2006 | Kono | C03C 3/085 333/181 |
| 7,477,127 | B2 * | 1/2009 | Kamijima | H01F 17/0013 336/206 |
| 7,675,396 | B2 | 3/2010 | Liu et al. | |
| 8,840,800 | B2 | 9/2014 | Suetsuna et al. | |
| 2003/0048167 | A1 * | 3/2003 | Inoue | H01F 17/04 336/200 |
| 2003/0214793 | A1 * | 11/2003 | Uchida | H01F 1/22 361/761 |
| 2009/0068426 | A1 * | 3/2009 | Nishizawa | H01F 17/0006 428/209 |
| 2009/0085703 | A1 * | 4/2009 | Liu | H01F 17/04 336/192 |
| 2009/0086703 | A1 | 4/2009 | Rofougaran et al. | |
| 2010/0308949 | A1 * | 12/2010 | Lim | H01F 17/0013 336/218 |
| 2012/0274328 | A1 * | 11/2012 | Hanington | G01V 5/04 324/324 |
| 2013/0002391 | A1 * | 1/2013 | Kim | H01F 27/24 336/233 |
| 2013/0127576 | A1 * | 5/2013 | Hachiya | H01F 27/255 336/200 |
| 2013/0222101 | A1 * | 8/2013 | Ito | H01F 17/04 336/83 |
| 2013/0228716 | A1 * | 9/2013 | Suetsuna | C22C 29/12 252/62.55 |
| 2013/0314194 | A1 * | 11/2013 | Sato | H01F 17/0013 336/200 |
| 2014/0292460 | A1 * | 10/2014 | Kim | H01F 27/255 336/178 |
| 2014/0333405 | A1 | 11/2014 | Choto et al. | |

FOREIGN PATENT DOCUMENTS

| | | | | |
|---|---|---|---|---|
| JP | 2004-297020 | A | 10/2004 | |
| JP | 2009-88470 | A | 4/2009 | |
| JP | 2012-138496 | A | 7/2012 | |
| JP | 2012138496 | A * | 7/2012 | H05K 1/16 |
| JP | 2013-65844 | A | 4/2013 | |
| KR | 10-2011-0128554 | A | 11/2011 | |
| KR | 10-2014-0121809 | A | 10/2014 | |
| KR | 10-2014-0131418 | A | 11/2014 | |
| KR | 10-2014-0133479 | A | 11/2014 | |

OTHER PUBLICATIONS

Final U.S. Office Action dated Jan. 26, 2018 issued in U.S. Appl. No. 15/009,125.

Non-final U.S. Office Action dated Apr. 14, 2017 issued in U.S. Appl. No. 15/009,125.

Office Action issued in Korean Patent Application No. 10-2015-0046310 dated Oct. 17, 2019, with English translation.

Office Action issued in corresponding Korean Patent Application No. 10-2015-0046310 dated Apr. 29, 2020, with English translation.

* cited by examiner

HYBRID INDUCTOR AND MANUFACTURING METHOD THEREOF

CROSS-REFERENCE TO RELATED APPLICATION

This application is a continuation of U.S. patent application Ser. No. 15/009,125 filed on Jan. 28, 2016 which claims the benefit of priority to Korean Patent Application No. 10-2015-0046310, filed on Apr. 1, 2015 with the Korean Intellectual Property Office, the entirety of which is incorporated herein by reference.

TECHNICAL FIELD

The present disclosure relates to a hybrid inductor and a manufacturing method thereof.

BACKGROUND

An inductor, a type of electronic component, is a passive element that can be used together with a resistor and a capacitor to configure an electronic circuit to remove noise therefrom.

A multilayer inductor may be manufactured by forming coil patterns on an insulating layer mainly formed of a magnetic material or a dielectric material, stacking the coil patterns to form an inductor body having a coil part, and forming external electrodes on external surfaces of the inductor body so that the coil part may be electrically connected to an external circuit.

SUMMARY

An aspect of the present disclosure provides a hybrid inductor capable of implementing excellent DC-Bias characteristics (inductance change characteristics according to current application) and high inductance (L), and a manufacturing method thereof.

According to an aspect of the present disclosure, a hybrid inductor includes cover parts and a core part in which magnetic saturation is rapidly generated due to concentrated magnetic flux in an inductor body. The core part includes magnetic metal layers having a high saturation magnetization value, and the cover parts include ferrite layers having a high permeability.

Each of the first and second cover parts may further comprise a magnetic metal layer disposed on a surface of the ferrite layer.

A thickness of the magnetic metal layer in the first and second cover parts may be 20% to 100% of a thickness of the ferrite layer in the first and second cover parts, respectively.

At least one of the magnetic metal layers may comprise an iron (Fe)-based alloy including iron (Fe) and at least one selected from the group consisting of silicon (Si), boron (B), chromium (Cr), aluminum (Al), copper (Cu), niobium (Nb), and nickel (Ni).

At least one of the magnetic metal layers may include magnetic metal particles having a saturation magnetization value of 100 emu/g to 250 emu/g.

At least one of the magnetic metal layers may include magnetic metal particles having a surface on which a metal oxide film is formed.

At least one of the ferrite layers may comprise ferrite including at least one element selected from the group consisting of nickel (Ni) and zinc (Zn).

At least one of the ferrite layers may comprise a glass including at least one oxide selected from the group consisting of silicon (Si) oxide, lithium (Li) oxide, boron (B) oxide, potassium (K) oxide, calcium (Ca) oxide, and aluminum (Al) oxide.

The coil part may comprise a plurality of coil patterns connected to each other by vias penetrating the magnetic metal layers, the coil patterns being formed on the plurality of magnetic metal layers.

According to another aspect of the present disclosure, a manufacturing method of a hybrid inductor comprises steps of: preparing a plurality of magnetic metal sheets and forming coil patterns on the magnetic metal sheets; forming a core part by stacking the magnetic metal sheets on which the coil patterns are formed; forming first and second cover parts by stacking ferrite sheets on an upper surface and below a lower surface of the core part; and forming an inductor body by sintering a laminate including the core part and the first and second cover parts.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
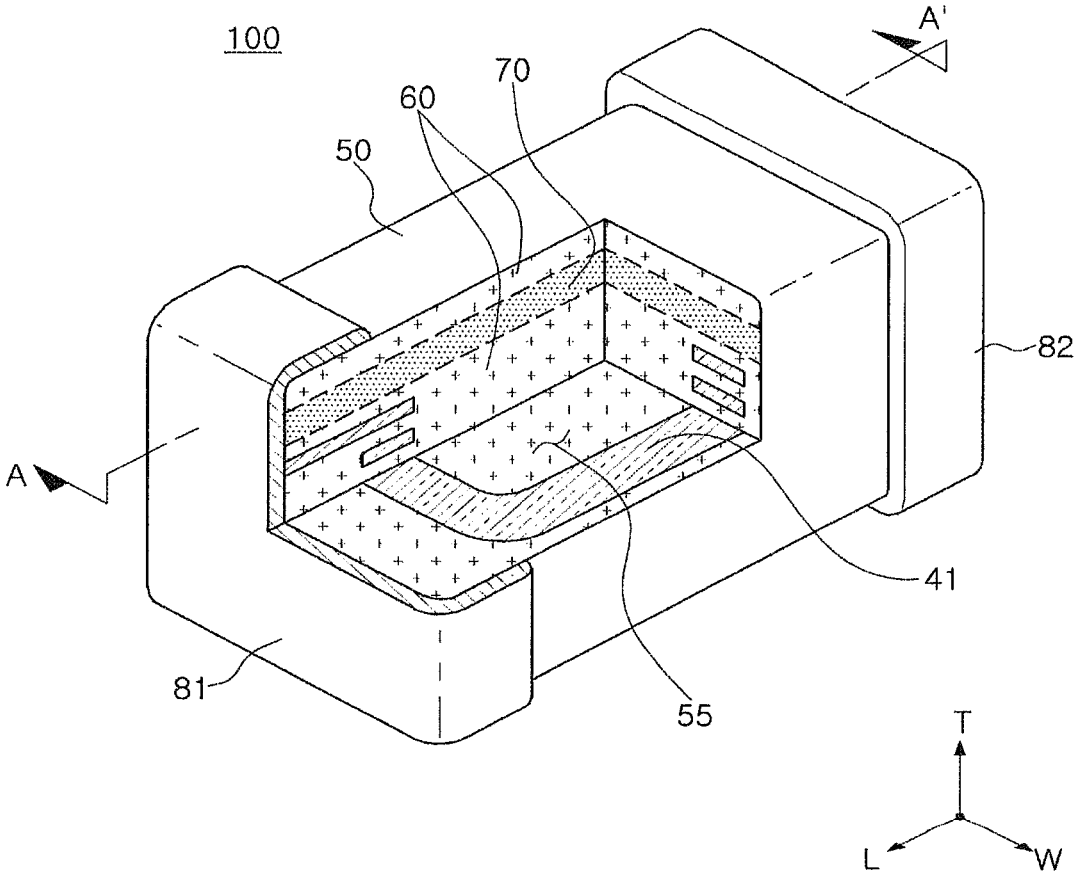
FIG. 1 is a cutaway perspective view illustrating a portion of a hybrid inductor according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Hybrid Inductor

Hereinafter, a hybrid inductor according to an exemplary embodiment in the present disclosure, in particular, a multilayer hybrid inductor will be described. However, the hybrid inductor is not necessarily limited thereto.

FIG. 1 is a cutaway perspective view illustrating portion of a hybrid inductor according to an exemplary embodiment in the present disclosure.

Referring to FIG. 1, the hybrid inductor 100 according to an exemplary embodiment in the present disclosure may include: an inductor body 50, coil patterns 41 formed in the inductor body 50, and first and second external electrodes 81 and 82 disposed on external surfaces of the inductor body 50 to be connected to lead parts of the coil patterns 41, respectively.

The hybrid inductor 100 according to an exemplary embodiment in the present disclosure may also include magnetic metal layers 60 and ferrite layers 70 in the inductor body 50.

In the hybrid inductor 100 according to an exemplary embodiment in the present disclosure, a 'length' direction refers to an 'L' direction of FIG. 1, a 'width' direction refers to a 'W' direction of FIG. 1, and a 'thickness' direction refers to a 'T' direction of FIG. 1.

The inductor body 50 may be formed by stacking plurality of magnetic metal layers 60 and ferrite layers 70.

The plurality of magnetic metal layers 60 and ferrite layers 70 may be in a sintered state and may be integrated so that it may be difficult to confirm boundaries between adjacent magnetic metal layers 60 and boundaries between adjacent ferrite layers 70 without using a scanning electron microscope (SEM).

In the inductor body 50 according to an exemplary embodiment in the present disclosure, a specific structure in which the magnetic metal layers 60 and the ferrite layers 70 are disposed will be described below.

In the exemplary embodiment in the present disclosure, one coil part 40 may be formed in the inductor body 50 by electrically connecting coil patterns 41 to each other by vias penetrating the magnetic metal layers 60, the coil patterns 41 being formed on the plurality of magnetic metal layers 60 at a predetermined thickness to each other.

The coil patterns 41 may be formed by applying a conductive paste containing a conductive metal to the magnetic metal layer 60 using a printing method, or the like.

The conductive metal forming the coil patterns 41 is not specifically limited as long as a metal having excellent electrical conductivity is used therein. For example, as the metal, silver (Ag), palladium (Pd), aluminum (Al), nickel (Ni), titanium (Ti), gold (Au), copper (Cu), platinum (Pt), or the like, may be used alone, or in combination.

A coil shaft center part 55 may be formed in the coil part formed by stacking the plurality of coil patterns 41.

Figure 2:
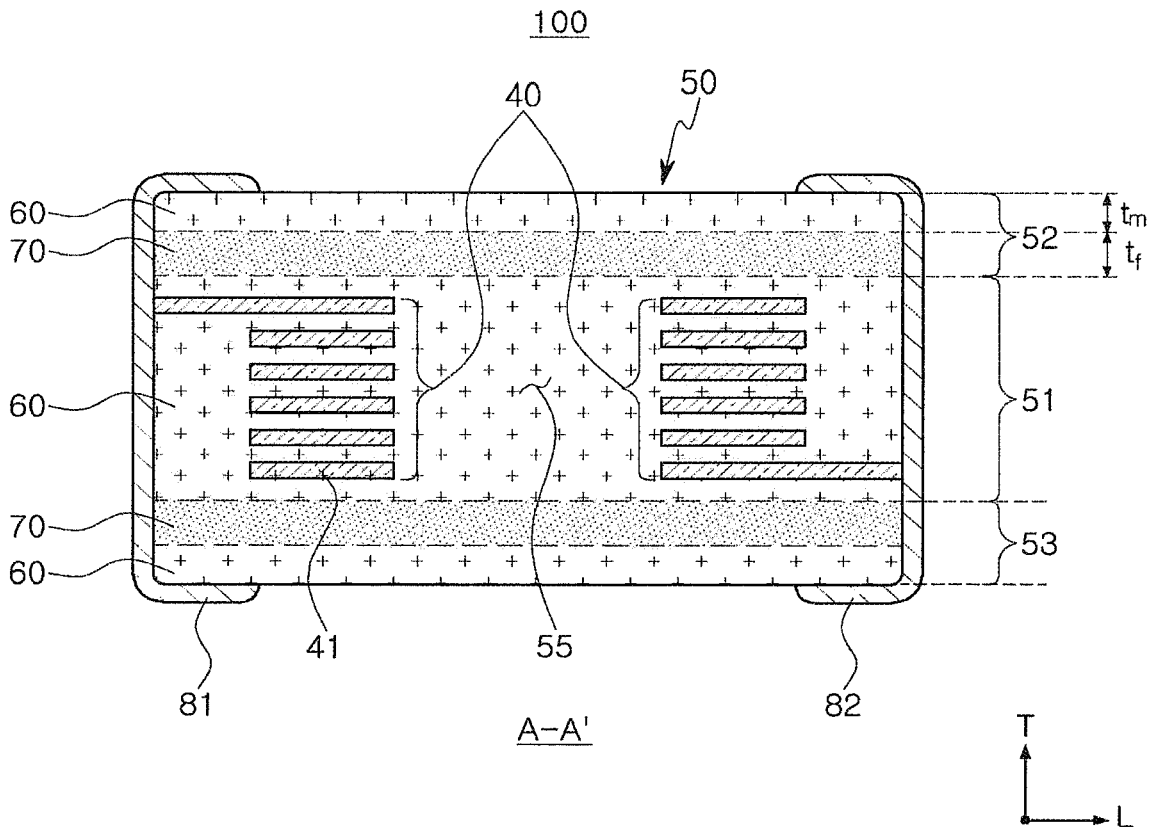
FIG. 2 is a cross-sectional view taken along line A-A' of FIG. 1.

FIG. 2 is a cross-sectional view taken along line A-A' of FIG. 1.

Referring to FIG. 2, the inductor body 50 may have a core part 51 in which the coil part 40 is disposed, and first and second cover parts 52 and 53 having the core part 51 interposed therebetween.

In the hybrid inductor according to an exemplary embodiment in the present disclosure, the core part 51 may include the magnetic metal layers 60 and the first and second cover parts 52 and 53 may include the ferrite layers 70.

In a general multilayer inductor having an inductor body containing only the ferrite, layers, the saturation magnetization value of ferrite materials is low, at about 70 emu/g or less, such that change characteristics in inductance according to current application may be large, thereby leading to difficulties in maintaining inductance at high current.

In a multilayer inductor having an inductor body containing only the magnetic metal layers, magnetic metal materials have a high saturation magnetization value, such that DC-Bias characteristic may be excellent, but the permeability may be low, thereby leading to difficulties in implementing high inductance.

In this regard, in an exemplary embodiment in the present disclosure, the magnetic metal layers 60 having a high saturation magnetization value may be formed in the core part 51 having the coil shaft center part 55 in which magnetic saturation is rapidly generated due to concentrated magnetic flux, and the ferrite layers 70 having a high permeability may be formed in the first and second cover parts 52 and 53 having a relatively low magnetic flux density.

Accordingly, excellent DC-Bias characteristics (changes in inductance characteristics according to current application) and high inductance (L) may be simultaneously implemented.

Furthermore, the first and second cover parts 52 and 53 of the inductor body 50 according to an exemplary embodiment in the present disclosure may further include magnetic metal layers 60 formed on surfaces of the ferrite layers 70.

Since the magnetic metal layers 60 and the ferrite layers 70 have different sintering shrinkage rates, the related art discloses problems such as the separation of interfaces of the magnetic metal layers 60 and the ferrite layers 70 due to differences in sintering shrinkage rates between the two different materials during sintering.

Regarding this, in an exemplary embodiment in the present disclosure, the magnetic metal layers 60 may be further formed on surfaces of the ferrite layers 70, such that the ferrite layers 70 may be constrained between the magnetic metal layers 60 having relatively small sintering shrinkage rates, thereby preventing interfacial separation due to differences in sintering shrinkage rates between the two different materials during sintering.

FIGS. 1 and 2 illustrate exemplary embodiments in which the magnetic metal layers 60 are further included on the outermost layers of the first and second cover parts 52 and 53, but FIGS. 1 and 2 are not necessarily limited thereto. Accordingly, any structure in which the magnetic metal layers 60 are formed on at least one surface of the ferrite layers 70 and the magnetic metal layers 60 are formed on both sides of the ferrite layers 70 having the ferrite layers 70 interposed therebetween may be applied.

A thickness $t_m$ of each of the magnetic metal layers 60 included in the first and second cover parts 52 and 53 may be 20% to 100% of a thickness $t_f$ of each of the ferrite layers 70.

When the thickness $t_m$ of each of the magnetic metal layers 60 is less than 20% of the thickness $t_f$ of each of the ferrite layers 70, the ferrite layers 70 may not be sufficiently constrained by the magnetic metal layers 60, such that interfacial separation may occur due to differences in sintering shrinkage rates between the two different materials. When the thickness $t_m$ of each of the magnetic metal layers 60 is more than 100% of the thickness $t_f$ of the ferrite layers 70, a ratio of the ferrite layers 70 having a high permeability to the magnetic metal layers may be excessively small, such that it may be difficult to implement high inductance.

The magnetic metal layer 60 may include an iron (Fe)-based alloy including iron (Fe) and at least one selected from the group consisting of silicon (Si), boron (B), chromium (Cr), aluminum (Al), copper (Cu), niobium (Nb), and nickel (Ni). For example, the iron (Fe)-based alloy may be a Fe—Si—Cr-based alloy, but the iron (Fe)-based alloy is not necessarily limited thereto.

For example, the magnetic metal layer 60 may include a Fe—Si—Cr-based alloy including 87 wt % or more of iron (Fe), 4 to 6 wt % of chromium (Cr), and residual silicon (Si).

In the Fe—Si—Cr-based alloy, when a content ratio of Fe is less than 87 wt %, magnetic properties may be largely deteriorated.

When the content ratio of Cr is 4 to 6 wt %, a chromium oxide film may be formed on surfaces of magnetic metal particles at a high sintering temperature during sintering, thereby preventing Fe from being oxidized. Meanwhile, when Cr has a content less than 4 wt %, when manufacturing a hybrid inductor, oxidation of Fe at the high sintering temperature may not be prevented, such that magnetic properties may be lost. When Cr has a content greater than 6 wt %, Cr oxide may be produced in an excess amount, such that a gap effect may be excessively increased further than a required amount, thereby deteriorating magnetic properties.

The magnetic metal particles included in the magnetic metal layer 60 may have a surface on which a metal oxide film is formed.

The metal oxide film may be formed by oxidizing at least one component of the magnetic metal particles. For example, the metal oxide film may include chromium oxide ($Cr_2O_3$). By the metal oxide film, insulation between the magnetic metal particles and insulation between the magnetic metal particles and the coil part 40 may be secured.

The magnetic metal particles included in the magnetic metal layer 60 may have a saturation magnetization value of 100 emu/g to 250 emu/g.

Since the magnetic metal layer 60 has a high saturation magnetization value of 100 emu/g to 250 emu/g, the magnetic metal layers 60 may be formed in the core part 51 having the coil shaft center part 55 in which magnetic saturation is rapidly generated due to concentrated magnetic flux, thereby improving DC-Bias characteristics.

The ferrite layers 70 may include ferrite including at least one element selected from the group consisting of nickel (Ni) and zinc (Zn). For example, the ferrite may be a Mn—Zn-based ferrite, a Ni—Zn-based ferrite, a Ni—Zn—Cu-based ferrite, and the like.

Meanwhile, the ferrite layers 70 may further include a glass formed of at least one oxide selected from the group consisting of silicon (Si) oxide, lithium (Li) oxide, boron (B) oxide, potassium (K) oxide, calcium (Ca) oxide, and aluminum (Al) oxide.

The glass may be included in the ferrite layers 70 to serve as a low temperature sintering agent. In order to perform co-sintering on the ferrite layers 70 and the magnetic metal layers 60 that are sintered at a relatively low temperature as compared to a temperature of the ferrite layers 70, the glass may be included in the ferrite layers 70. For example, the glass may be a low temperature sintering agent glass represented by $LiO_2$—$B_2O_3$—$SiO_2$.

Figure 3:
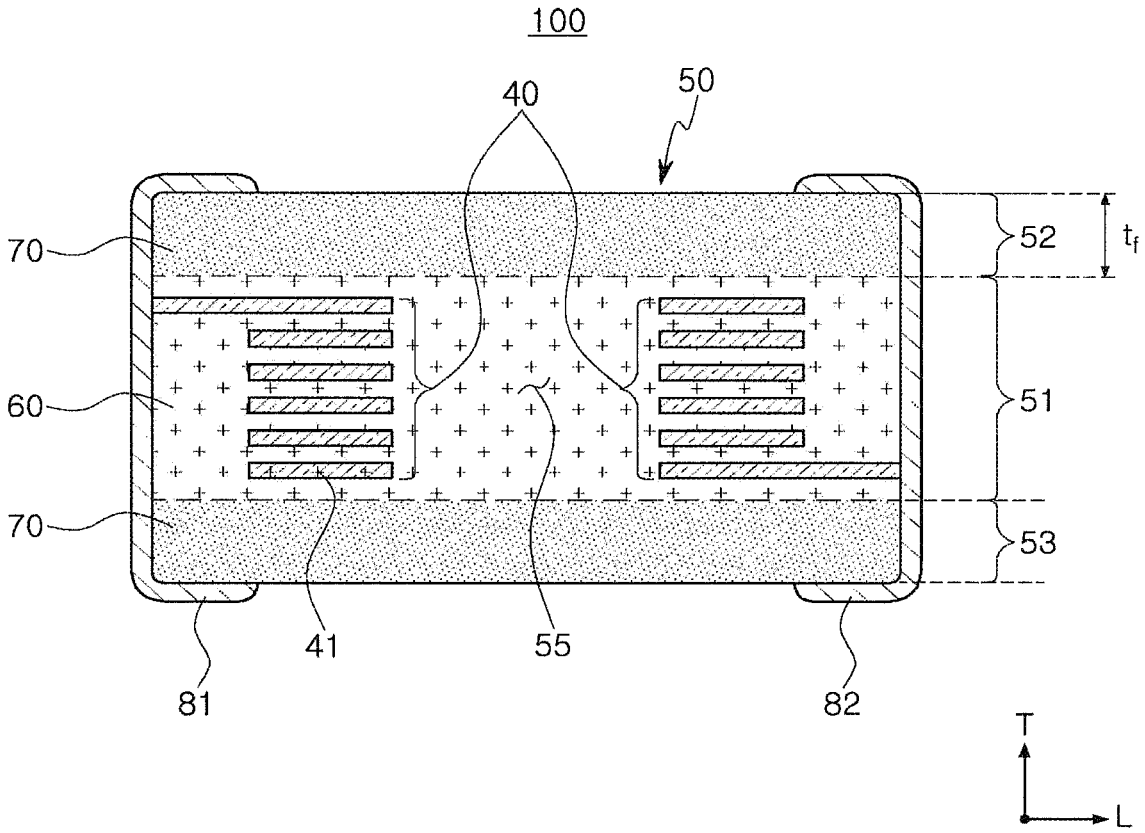
FIG. 3 is a cross-sectional view of a hybrid inductor according to another exemplary embodiment in the present disclosure in a length-thickness (L-T) direction.

FIG. 3 is a cross-sectional view of a hybrid inductor according to another exemplary embodiment in the present disclosure in a length-thickness (L-T) direction.

Referring to FIG. 3, in the hybrid inductor 100 according to another exemplary embodiment in the present disclosure, the magnetic metal layers 60 having a high saturation magnetization value were formed in the core part 51 having the coil shaft center part 55 in which magnetic saturation was rapidly generated due to concentrated magnetic flux, and the ferrite layers 70 having a high permeability were formed in the entirety of the first and second cover parts 52 and 53 having a relatively low magnetic flux density.

Accordingly, excellent DC-Bias characteristics (change characteristics in inductance according to a current application) and high inductance (L) may be simultaneously implemented.

As illustrated in FIG. 3, when only the ferrite layers 70 are included in the first and second cover parts 52 and 53, a volume occupied by the ferrite layers 70 having a high permeability may be increased to implement higher inductance. Meanwhile, at the time of co-sintering on the magnetic metal layers 60 and the ferrite layers 70, interfacial separation may occur due to the difference in sintering shrinkage rates of the two different materials during co-sintering.

Figure 4:
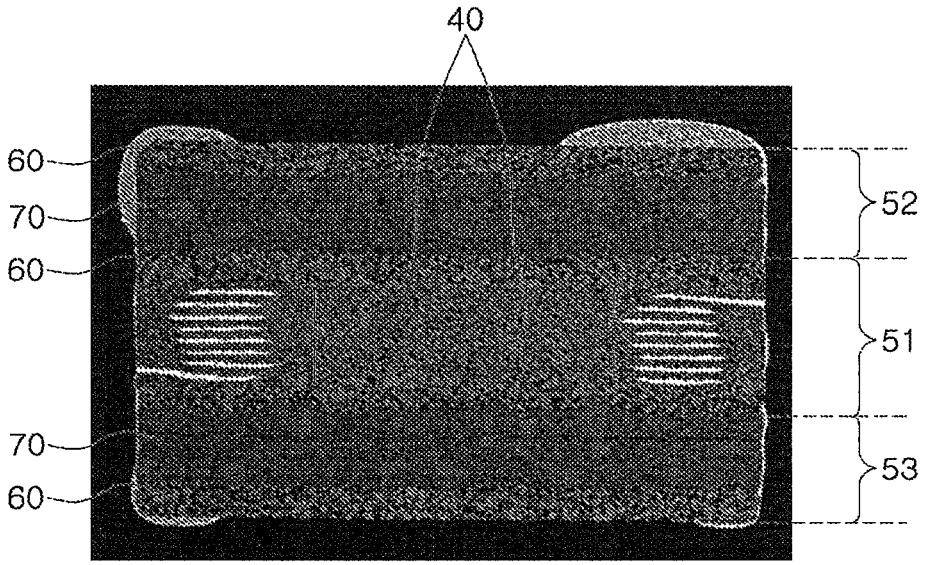
FIG. 4 is a scanning electron microscope (SEM) image illustrating a cross-section of the hybrid inductor according to an exemplary embodiment in the present disclosure in a length-thickness (L-T) direction.

FIG. 4 is a scanning electron microscope (SEM) image illustrating a cross-section of the hybrid inductor according to an exemplary embodiment in the present disclosure in a length-thickness (L-T) direction.

Referring to FIG. 4, it may be confirmed that the magnetic metal layers 60 and the ferrite layers 70 are separated from each other.

In the hybrid inductor according to an exemplary embodiment in the present disclosure illustrated in FIG. 4, the magnetic metal layers 60 having a high saturation magnetization value were formed in the core part 51 having the coil shaft center part 55 in which magnetic saturation is rapidly generated due to concentrated magnetic flux, and the ferrite layers 70 having a high permeability were formed in the first and second cover parts 52 and 53 having a relatively low magnetic flux density, and then the magnetic metal layers 60 may be further formed on surfaces of the ferrite layers 70.

Accordingly, excellent DC-Bias characteristic (inductance change characteristics according to current application) and high inductance (L) may be simultaneously implemented, and the ferrite layers 70 may be constrained between the magnetic metal layers 60, thereby preventing interfacial separation due to the difference in sintering shrinkage rates between the two different materials during sintering.

FIG. 5 is a graph illustrating inductance (a) and a Rate of DC-Bias change (b) according to a current application, of the hybrid inductor according to an exemplary embodiment in the present disclosure and a metal multilayer inductor, manufactured by stacking only general magnetic metal layers.

Figure 5A:
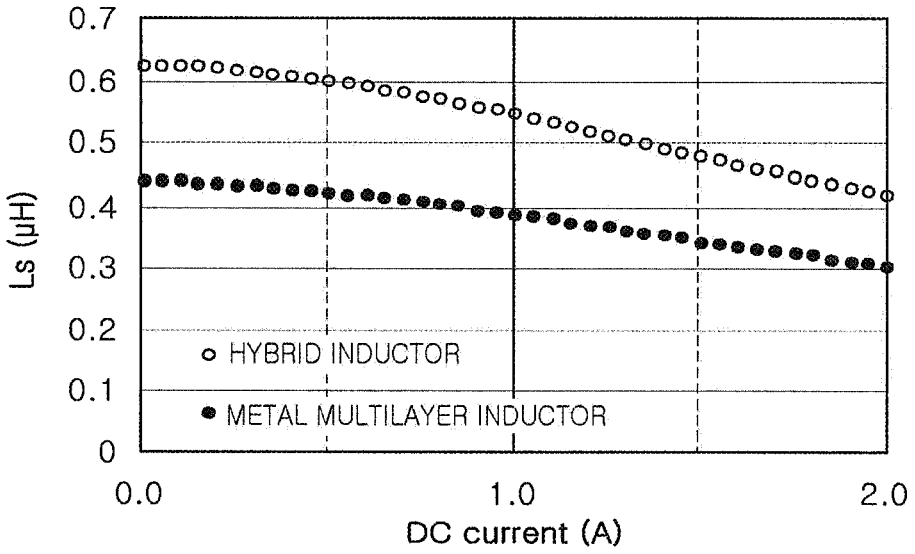
FIGS. 5A and 5B are graphs illustrating inductance (A) and a Rate of DC-Bias change (B) according to a current application, of the hybrid inductor according to an exemplary embodiment in the present disclosure and of a metal multilayer inductor manufactured by only stacking general magnetic metal layers.

Referring to FIG. 5A, it may be observed that the hybrid inductor according to an exemplary embodiment in the present disclosure has remarkably high inductance as compared to the metal multilayer inductor.

Figure 5B:
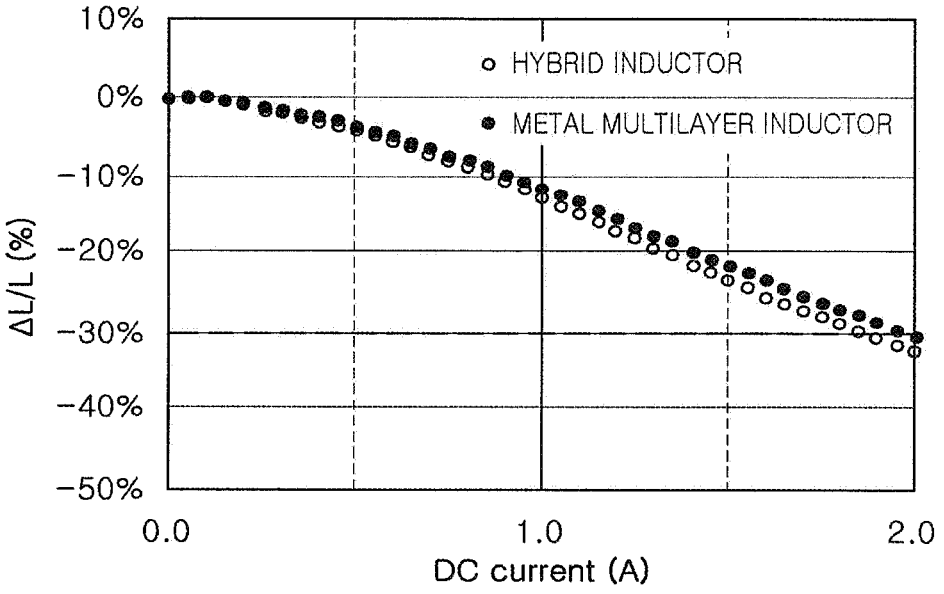

Referring to FIG. 5B, it may be observed that the hybrid inductor according to an exemplary embodiment in the present disclosure and the metal multilayer inductor have a similar rate of DC-Bias change according to current application without significant difference.

That is, a general metal multilayer inductor has excellent DC-Bias characteristics due to a high saturation magnetization value, but low inductance due to a low permeability. However, in the hybrid inductor according to an exemplary embodiment in the present disclosure, excellent DC-Bias characteristics and high inductance were implemented by forming the magnetic metal layers 60 having a high saturation magnetization value in the core part 51, and forming the ferrite layers 70 having a high permeability in the first and second cover parts 52 and 53.

Manufacturing Method of Hybrid Inductor

Figure 6:
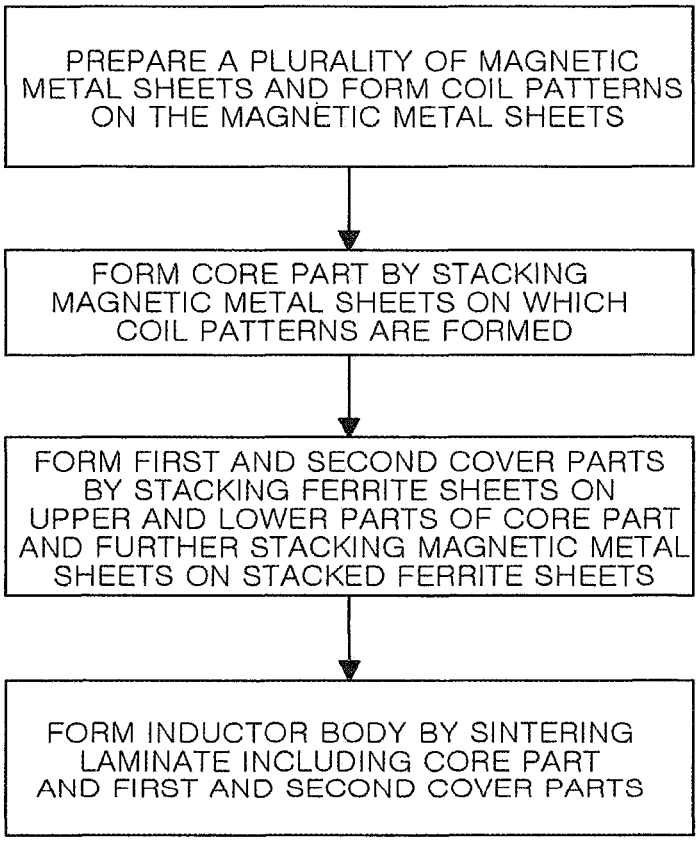
FIG. 6 is a process flow chart illustrating manufacturing method of the hybrid inductor according to an exemplary embodiment in the present disclosure.

FIG. 6 is a process flow chart illustrating a method of manufacturing the hybrid inductor according to an exemplary embodiment in the present disclosure.

Referring to FIG. 6, a plurality of magnetic metal sheets may be prepared and coil patterns may be formed on the magnetic metal sheets.

The magnetic metal sheets may be formed as sheets by mixing magnetic metal particles with organic materials to prepare a slurry, and applying the slurry at a thickness of several tens of micrometers (μm) on a carrier film by a doctor blade method, followed by drying.

The magnetic metal particles may be an iron (Fe)-based alloy including iron (Fe) and at least one selected from the group consisting of silicon (Si), boron (B), chromium (Cr), aluminum (Al), copper (Cu), niobium (Nb), and nickel (Ni). For example, the magnetic metal particles may be a Fe—Si—Cr-based alloy, but the magnetic metal particles are not necessarily limited thereto.

For example, the magnetic metal particles may be a Fe—Si—Cr-based alloy including 87 wt % or more of iron (Fe), 4 to 6 wt % of chromium (Cr), and residual silicon (Si).

In the Fe—Si—Cr-based alloy, when the content ratio of Fe is less than 87 wt %, magnetic properties may be largely deteriorated.

When the content ratio of Cr is 4 to 6 wt %, a chromium oxide film may be formed on surfaces of the magnetic metal particles at a high sintering temperature during sintering, thereby preventing Fe from being oxidized. Meanwhile, when Cr has a content less than 4 wt %, when manufacturing the hybrid inductor, oxidation of Fe at a high sintering temperature may not be prevented, such that magnetic properties may be lost. When Cr has a content more than 6 wt %, Cr oxide may be produced in an excessive amount, such that a gap effect may be excessively increased further than the required amount, thereby deteriorating magnetic properties.

The coil patterns 41 may be formed by applying a conductive paste containing a conductive metal to the magnetic metal sheets by a printing method, and the like.

The printing method of the conductive paste may be a screen printing method, a gravure printing method, and the like, but the printing method of the conductive paste is not necessarily limited thereto.

The conductive metal is not specifically limited as long as a metal having excellent electrical conductivity is used. For example, as the metal, silver (Ag), palladium (Pd), aluminum (Al), nickel (Ni), titanium (Ti), gold (Au), copper (Cu), platinum (Pt) or the like, may be used alone or in combination.

Vias may be formed at predetermined positions of the magnetic metal sheets on which the coil patterns 41 are printed.

Next, a core part 51 may be formed by stacking the magnetic metal sheets on which the coil patterns 41 are formed.

Here, the coil part 40 may be formed by connecting the coil patterns 41 to each other by vias formed in the magnetic metal sheets, the coil patterns 41 being formed on each magnetic metal sheet.

The magnetic metal particles included in the magnetic metal sheets may have a saturation magnetization value of 100 emu/g to 250 emu/g.

Since the magnetic metal particles have a high saturation magnetization value of 100 emu/g to 250 emu/g, the core part 51 having the coil shaft center part 55 in which magnetic saturation is rapidly generated due to concentrated magnetic flux may be formed by stacking the magnetic metal sheets including the magnetic metal particles, thereby improving DC-Bias characteristic.

Next, ferrite sheets may be stacked on upper and lower parts of the core part 51 to form first and second cover parts 52 and 53.

The ferrite sheets may be formed as sheets by mixing ferrite with organic materials to prepare slurry, and applying the slurry at a thickness of several tens of micrometers (μm) on a carrier film by a doctor blade method, followed by drying.

The ferrite included in the ferrite sheet may be a ferrite including at least one element selected from the group consisting of nickel (Ni) and zinc (Zn). For example, the ferrite, may be a Mn—Zn-based ferrite, a Ni—Zn-based ferrite, a Ni—Zn—Cu-based ferrite, and the like.

Meanwhile, the ferrite sheet may further include a glass formed of at least one oxide selected from the group consisting of silicon (Si) oxide, lithium (Li) oxide, boron (B) oxide, potassium (K) oxide, calcium (Ca) oxide, and aluminum (Al) oxide.

The glass may be included in the ferrite sheets to serve as a low temperature sintering agent. In order to perform co-sintering on the ferrite sheets and the magnetic metal sheets that are sintered at a relatively low temperature as compared to a temperature of the ferrite sheets, the glass may be included in the ferrite sheet. For example, the glass may be a low temperature sintering agent glass represented by $LiO_2$—$B_2O_3$—$SiO_2$.

The ferrite may have a lower saturation magnetization value than that of the magnetic metal particle, but may have a high permeability, such that when the first and second cover parts 52 and 53 having a relatively low magnetic flux density are formed into the ferrite sheets including ferrite having a high Permeability, high inductance (L) may be implemented.

Then, after the ferrite sheets are stacked, the magnetic metal sheets may be further stacked on the stacked ferrite sheets, thereby forming the first and second cover parts 52 and 53 in which the magnetic metal sheets are further formed on surfaces of the ferrite sheets.

Since the magnetic metal sheets and the ferrite sheets have different sintering shrinkage rates, there was a problem in which interfacial separation occurs between magnetic metal layers 60 and ferrite layers 70 sintered due to difference in sintering shrinkage of two materials during sintering.

Regarding this, in an exemplary embodiment in the present disclosure, after the ferrite sheets are stacked, the magnetic metal sheets may be further stacked on the stacked ferrite sheets, such that the ferrite layers 70 may be constrained between the magnetic metal layers 60 having relatively small sintering shrinkage rates, thereby preventing interfacial separation due to differences in sintering shrinkage rates between the two different materials during sintering.

A thickness at which the magnetic metal sheets forming the first and second cover parts 52 and 53 are stacked may be 20% to 100% of a height of the stacked ferrite sheets.

When the thickness at which the magnetic metal sheets are stacked is less than 20% of the height of the stacked ferrite sheets, the ferrite layers 70 may not be sufficiently constrained by the magnetic metal layers 60 during sintering, such that interfacial separation may occur due to differences in sintering shrinkage rates between the two different materials. In addition, when the thickness at which magnetic metal sheets are stacked is more than 100% of the height of the stacked ferrite sheets, the ratio of the ferrite sheets having a high permeability to the magnetic metal layers may be excessively small, such that it may be difficult to implement high inductance.

Then, an inductor body 50 may be formed by sintering a laminate including the core part 51 and the first and second cover parts 52 and 53.

The inductor body 50 may be formed by co-sintering the magnetic metal sheets forming the core part 51, and the ferrite sheets and the magnetic metal sheets forming the first and second cover parts 52 and 53.

At the time of co-sintering the laminate, the core part 51 and the first and second cover parts 52 and 53 may be co-sintered at 750° C. to 800° C.

When a temperature for co-sintering is less than 750° C., the ferrite sheets and the magnetic metal sheets may not be sufficiently sintered, such that it may be difficult to implement characteristics of the inductor. When the temperature for co-sintering is more than 800° C., the magnetic metal particles may be excessively oxidized, such that magnetic properties may be deteriorated.

In an exemplary embodiment in the present disclosure, after the ferrite sheets are stacked, the magnetic metal sheets may be further stacked on the stacked ferrite sheets, such that interfacial separation due to differences in the sintering shrinkage rates between the two different materials during sintering may be prevented.

The following Table 1 shows results of inductance, Q characteristic, series resistance (Rs), and direct current resistance (Rdc) of the hybrid inductor according to the exemplary embodiment in the present disclosure. The hybrid inductor was manufactured by forming the core part 51 including the magnetic metal layers 60 and then forming the first and second cover parts 52 and 53 by forming the ferrite layers 70 on the core part 51 and then forming the magnetic metal layers 60 on the ferrite layers 70.

The hybrid inductor had a size (L*W) of 1.60×0.80 [mm].

TABLE 1

| | Inductance (uH) | Q | Rs | Rdc |
|---|---|---|---|---|
| 1 | 0.712 | 20.3 | 0.68 | 254.0 |
| 2 | 0.704 | 20.3 | 0.68 | 254.0 |
| 3 | 0.691 | 21.0 | 0.64 | 239.0 |
| 4 | 0.695 | 20.7 | 0.65 | 246.0 |
| 5 | 0.705 | 20.2 | 0.68 | 257.0 |
| 6 | 0.692 | 20.3 | 0.67 | 251.0 |
| 7 | 0.714 | 21.1 | 0.66 | 248.0 |
| 8 | 0.702 | 20.8 | 0.66 | 240.0 |
| 9 | 0.713 | 20.7 | 0.67 | 253.0 |
| 10 | 0.721 | 20.7 | 0.68 | 248.0 |
| Avg | 0.705 | 20.621 | 0.67 | 249.0 |
| Max | 0.721 | 21.104 | 0.68 | 257.0 |
| Min | 0.691 | 20.210 | 0.64 | 239.0 |
| Stdev | 0.010 | 0.324 | 0.01 | 6.02 |

The following Table 2 shows results of inductance, Q characteristics, series resistance (Rs), and direct current resistance (Rdc) of a metal multilayer inductor manufactured by stacking the magnetic metal layers only.

The metal multilayer inductor had a size (L*W) of 1.60×0.80 [mm].

TABLE 2

| | Inductance (uH) | Q | Rs | Rdc |
|---|---|---|---|---|
| 1 | 0.443 | 19.7 | 0.67 | 249.0 |
| 2 | 0.438 | 20.0 | 0.67 | 242.0 |
| 3 | 0.436 | 20.0 | 0.66 | 248.0 |

TABLE 2-continued

| | Inductance (uH) | Q | Rs | Rdc |
|---|---|---|---|---|
| 4 | 0.443 | 20.4 | 0.65 | 243.0 |
| 5 | 0.439 | 20.1 | 0.65 | 245.0 |
| 6 | 0.435 | 20.4 | 0.65 | 246.0 |
| 7 | 0.443 | 19.5 | 0.69 | 254.0 |
| 8 | 0.444 | 20.4 | 0.65 | 243.0 |
| 9 | 0.431 | 20.1 | 0.68 | 247.0 |
| 10 | 0.440 | 20.4 | 0.67 | 244.0 |
| Avg | 0.439 | 20.099 | 0.66 | 246.10 |
| Max | 0.444 | 20.415 | 0.69 | 254.00 |
| Min | 0.431 | 19.493 | 0.65 | 242.00 |
| Stdev | 0.004 | 0.316 | 0.01 | 3.60 |

Referring to Tables 1 and 2, it may be appreciated that the hybrid inductor according to an exemplary embodiment in the present disclosure has remarkably high inductance as compared to the metal multilayer inductor. Meanwhile, it may be appreciated that the hybrid inductor according to an exemplary embodiment in the present disclosure and the metal multilayer inductor have similar excellent values for Q characteristic, series resistance (Rs), and direct current resistance (Rdc) without significant difference.

As set forth above, according to exemplary embodiments in the present disclosure, a hybrid inductor having excellent DC-Bias characteristics (inductance change characteristics according to current application) and high inductance (L) may be implemented by including magnetic metal layers in a core part in which magnetic saturation is rapidly generated due to concentrated magnetic flux, and ferrite layers in the cover parts.

While exemplary embodiments have been shown and described above, it will be apparent to those skilled in the art that modifications and variations could be made without departing from the scope of the present disclosure as defined by the appended claims.

What is claimed is:

1. A hybrid inductor comprising:

an inductor body having a core part in which a coil part is disposed, and first and second cover parts, the core part being interposed between the first and second cover parts, wherein the core part comprises layers of a first magnetic metal, wherein each of the first and second cover parts comprises a ferrite layer and a layer of a second magnetic metal disposed on an outer surface of the ferrite layer such that the ferrite layer of each of the first and second cover parts is disposed between one of the layers of the first magnetic metal and the layer of the second magnetic metal, wherein the layer of the second magnetic metal includes a metal alloy, wherein the ferrite layer of at least one of the first cover part or the second cover part is spaced apart, by the one of the layers of the first magnetic metal, from the coil part in a thickness direction of the hybrid inductor, and wherein the ferrite layer of at least one of the first cover part or the second cover part is arranged between the core part and the layer of the second magnetic metal in the thickness direction of the hybrid inductor.

2. The hybrid inductor of claim 1, wherein a thickness of the layer of the second magnetic metal is 20% to 100% of a thickness of the ferrite layer in the first and second cover parts.

3. The hybrid inductor of claim 1, wherein at least one of the first magnetic metal or the second magnetic metal comprises an iron (Fe)-based alloy including iron (Fe) and at least one selected from the group consisting of silicon (Si), boron (B), chromium (Cr), aluminum (Al), copper (Cu), niobium (Nb), and nickel (Ni).

4. The hybrid inductor of claim 1, wherein at least one of the first magnetic metal or the second magnetic metal includes magnetic metal particles having a saturation magnetization value of 100 emu/g to 250 emu/g.

5. The hybrid inductor of claim 1, wherein at least one of the first magnetic metal or the second magnetic metal includes magnetic metal particles having a surface on which a metal oxide film is disposed.

6. The hybrid inductor of claim 1, wherein at least one of the ferrite layers comprises ferrite including at least one element selected from the group consisting of nickel (Ni) and zinc (Zn).

7. The hybrid inductor of claim 1, wherein at least one of the ferrite layers comprises a glass including at least one oxide selected from the group consisting of silicon (Si) oxide, lithium (Li) oxide, boron (B) oxide, potassium (K) oxide, calcium (Ca) oxide, and aluminum (Al) oxide.

8. The hybrid inductor of claim 1, wherein the coil part comprises a plurality of coil patterns connected to each other by vias penetrating the layers of the first magnetic metal, the coil patterns being disposed on the layers of the first magnetic metal.

9. The hybrid inductor of claim 3, wherein the iron (Fe)-based alloy includes 87 wt % or more of iron (Fe), 4 to 6 wt % of chromium (Cr), and residual silicon, based on a total weight of the iron (Fe)-based alloy.

10. The hybrid inductor of claim 1, wherein the first magnetic metal and the second magnetic metal comprise the same material.

11. A hybrid inductor comprising:

an inductor body having a core part in which a coil part is disposed, and first and second cover parts, the core part being interposed between the first and second cover parts, wherein the core part comprises layers of a first magnetic metal, wherein each of the first and second cover parts comprises a ferrite layer and a layer of a second magnetic metal disposed on an outer surface of the ferrite layer such that the layers of the second magnetic metal are exposed to an external surface of the hybrid inductor, wherein the layer of the second magnetic metal includes a metal alloy, wherein the ferrite layer of at least one of the first cover part or the second cover part is spaced apart, by one of the layers of the first magnetic metal, from the coil part in a thickness direction of the hybrid inductor, and wherein the ferrite layer of at least one of the first cover part or the second cover part is arranged between the core part and the layer of the second magnetic metal in the thickness direction of the hybrid inductor.

12. The hybrid inductor of claim 11, wherein a thickness of the layer of the second magnetic metal is 20% to 100% of a thickness of the ferrite layer in the first and second cover parts.

13. The hybrid inductor of claim 11, wherein at least one of the first magnetic metal or the second magnetic metal comprises an iron (Fe)-based alloy including iron (Fe) and at least one selected from the group consisting of silicon (Si), boron (B), chromium (Cr), aluminum (Al), copper (Cu), niobium (Nb), and nickel (Ni).

14. The hybrid inductor of claim 11, wherein at least one of the first magnetic metal or the second magnetic metal includes magnetic metal particles having a saturation magnetization value of 100 emu/g to 250 emu/g.

15. The hybrid inductor of claim 11, wherein at least one of the first magnetic metal or the second magnetic metal includes magnetic metal particles having a surface on which a metal oxide film is disposed.

16. The hybrid inductor of claim 11, wherein at least one of the ferrite layers comprises ferrite including at least one element selected from the group consisting of nickel (Ni) and zinc (Zn).

17. The hybrid inductor of claim 11, wherein at least one of the ferrite layers comprises a glass including at least one oxide selected from the group consisting of silicon (Si) oxide, lithium (Li) oxide, boron (B) oxide, potassium (K) oxide, calcium (Ca) oxide, and aluminum (Al) oxide.

18. The hybrid inductor of claim 11, wherein the coil part comprises a plurality of coil patterns connected to each other by vias penetrating the layers of the first magnetic metal, the coil patterns being disposed on the layers of the first magnetic metal.

19. The hybrid inductor of claim 13, wherein the iron (Fe)-based alloy includes 87 wt % or more of iron (Fe), 4 to 6 wt % of chromium (Cr), and residual silicon, based on a total weight of the iron (Fe)-based alloy.

20. The hybrid inductor of claim 11, wherein the first magnetic metal and the second magnetic metal comprise the same material.

* * * * *